US008023874B2

(12) United States Patent
Horiuchi

(10) Patent No.: US 8,023,874 B2
(45) Date of Patent: Sep. 20, 2011

(54) IMAGE FORMING APPARATUS HAVING TRANSFER BIAS APPLYING SECTION AND IMAGE FORMING METHOD HAVING THE SAME FOR TRANSFERRING TONER IMAGE

(75) Inventor: Nobuhiro Horiuchi, Osaka (JP)

(73) Assignee: KYOCERA MITA Corporation, Osaka (JP)

( * ) Notice: Subject to any disclaimer, the term of this patent is extended or adjusted under 35 U.S.C. 154(b) by 384 days.

(21) Appl. No.: 12/199,044

(22) Filed: Aug. 27, 2008

(65) Prior Publication Data

US 2009/0060595 A1 Mar. 5, 2009

(30) Foreign Application Priority Data

Sep. 5, 2007 (JP) ..... 2007-229973

(51) Int. Cl.
*G03G 15/20* (2006.01)
*G03G 15/10* (2006.01)

(52) U.S. Cl. ..... 399/314; 399/308; 399/237; 399/249

(58) Field of Classification Search ..... 399/314
See application file for complete search history.

(56) References Cited

U.S. PATENT DOCUMENTS 5,159,392 A * 10/1992 Kasahara et al. ..... 399/309
5,438,398 A * 8/1995 Tanigawa et al. ..... 399/302
2001/0016129 A1* 8/2001 Uezono et al. ..... 399/237
2002/0159801 A1* 10/2002 Nakashima et al. ..... 399/307
2005/0019049 A1* 1/2005 Shin ..... 399/66

FOREIGN PATENT DOCUMENTS

JP 2002-296926 10/2002

* cited by examiner

*Primary Examiner* — David Gray
*Assistant Examiner* — David Bolduc
(74) *Attorney, Agent, or Firm* — Frommer Lawrence & Haug LLP

(57) ABSTRACT

The present invention teaches and claims an image forming apparatus comprising an image forming portion using a liquid developer having a carrier liquid and toner; an intermediate transfer section which has an endless belt and a plurality of rotating bodies; a second transfer roller which is disposed so that it faces one of the plurality of rotating bodies and abuts the endless belt; a first bias applying section which is connected to the second transfer roller and applies a transfer bias to the second-transfer roller when the second transfer is done and applies a reverse transfer bias having an opposite electric polarity as the transfer bias to the second transfer roller when the second transfer is not performed; and a second bias applying section which is connected to the rotating body facing the second transfer roller and applies a bias to the rotating body facing the second transfer roller.

14 Claims, 9 Drawing Sheets

IMAGE FORMING APPARATUS HAVING TRANSFER BIAS APPLYING SECTION AND IMAGE FORMING METHOD HAVING THE SAME FOR TRANSFERRING TONER IMAGE

INCORPORATION BY REFERENCE

This application is based upon and claims the benefit of priority from the corresponding Japanese Patent application No. 2007-229973, filed Sep. 5, 2007, the entire contents of which is incorporated herein by reference.

FIELD OF THE INVENTION

The present invention teaches and claims an image forming apparatus, such as a printer, a copying machine, a multifunctional peripheral, and/or a facsimile, in which a liquid developer comprising a carrier liquid and toner is used.

BACKGROUND OF THE INVENTION

Conventionally, there is an image forming apparatus (so-called wet type image forming apparatus) such as a printer and a copying machine in which the liquid developer including a carrier liquid and toner is used to form an image by an electrophotographic process. Particularly, in an image forming apparatus compatible with a color image, toner image formed on a plural photosensitive bodies which are of image bearing members are superimposed on an endless belt which is of an intermediate transfer body (first transfer) to form a full color toner image. Next, the full color toner image is transferred via a second transfer to paper which is of a recording medium.

In the image forming apparatus in which the intermediate transfer body is used, a second transfer roller press contacts the intermediate transfer body so that a nip is formed between the second transfer roller and the intermediate transfer body. The paper enters the nip while a second transfer bias voltage (current) having an opposite polarity to a polarity of the toner is applied to the second transfer roller, and the toner is sucked into the paper by an electrostatic force to perform the second transfer. On the other hand, except for the time of the second transfer, a reverse transfer bias having an opposite polarity to the second transfer bias is applied to the second transfer roller such that the residual toner on the intermediate transfer body are not attracted to the second transfer roller. When the toner adheres to the second transfer roller, the paper is contaminated. Additionally, the toner is fixed to the second transfer roller because the second transfer roller press contacts the intermediate transfer belt. As a result, the second transfer roller is unevenly charged, which possibly causes a second transfer defect.

In the wet type image forming apparatus, usually the image is formed using a carrier liquid which is of oil in nature (for example, silicone oil). Therefore, the carrier liquid adheres to the intermediate transfer body or the second transfer roller, and the paper twists easily around the intermediate transfer body or the second transfer roller due to the high viscosity of the carrier liquid, which sometimes causes a defect in a paper conveyer.

For example, Japanese patent Laid-Open Publication No. 2002-296926 relates to an image forming apparatus which prevents the adhesion of the liquid developer to a transfer member (second transfer roller) and re-adhesion of the liquid developer to an intermediate transfer body or a recoding medium. Specifically, the image forming apparatus includes a developer bearing member which bears the liquid developer in which the toner is dispersed into the carrier liquid, an image bearing member which bears a developed image, an intermediate transfer body which first transfers the developed image on the image bearing member, and a second transfer part for second transferring the developed image transferred onto the intermediate transfer body to the recoding medium. Additionally, the second transfer part includes a transfer member and a cleaning member, and the cleaning member is formed by an elastic body for cleaning a surface of the transfer member. In the image forming apparatus field, enhancement of an image forming speed is desirable and in demand, and this high-speed image formation is one of many factors for consideration when a user selects an image forming apparatus. However, the enhancement of an image forming speed means that a paper conveyer speed is enhanced. That is, a time period for the second transfer is shortened.

Unfortunately, in the case of an image having a small margin, the second transfer is not performed in a leading end portion (i.e., head portion of a page) of the image, and sometimes a portion to be printed is lacked or thinned (see FIG. 9B). The lack of the leading end portion is caused by performing the insufficient second transfer. That is, although a certain period of time (transition time) is required for a bias voltage (current) to reach a value necessary for the second transfer from a reverse transfer bias state, the toner image reaches, due to the speed enhancement, a position at which the toner image contacts the paper before the bias voltage reaches the value necessary for the second transfer.

Therefore, when the image has a narrow margin, usually a timing for starting electric polarity reversal from the reverse transfer bias to the transfer bias is set ahead. Herewith, when the toner image enters a second transfer nip, the second transfer bias voltage (current) is applied such that the second transfer roller reaches the value necessary for the second transfer. The second transfer transfers the image onto the paper without lacking the top portion of the image. But, the paper has a static charge because it is in contact with another paper and guide members of the conveyance path. Therefore, if the timing for starting electric polarity reversal is set ahead, when the sheet enters the second transfer nip, the relatively great bias is already applied to the second transfer roller. Therefore, the sheet is easily electrically attracted to the second transfer roller or the intermediate transfer body and twists around them. Furthermore, in the wet-type image forming apparatus, because of the high viscosity of the carrier liquid the sheet tends to twist around the second transfer roller and the like. Especially, there are paper jam problems that tend to occur at the second transfer nip by a combination of the high voltage and high viscosity when the timing for starting electric polarity reversal from the reverse transfer bias to the transfer bias is set ahead in the wet-type image forming apparatus.

In the image forming apparatus disclosed in Japanese patent Laid-Open Publication No. 2002-296926, in the case where the image forming speed is enhanced, and in the case where the margin next to the image is small, the problem of lacking the leading end portion of the image can be solved only when the timing for starting polarity reversal is set ahead. In that case, in the image forming apparatus disclosed in Japanese patent Laid-Open Publication No. 2002-296926, the paper jam often happens because of the paper twisting around the second transfer roller and the like and the above mentioned problem cannot be solved.

In the image forming apparatus disclosed in Japanese patent Laid-Open Publication No. 2002-296926, although the toner or carrier liquid adhering to the second transfer roller can be removed to some extent by the existence of a cleaning member, the fundamental problem of the easy contamination of the second transfer roller is not solved when the timing for starting the polarity reversal of the second transfer bias is set ahead. The cleaning member does not completely remove the contamination of the second transfer roller. In consideration of early abrasion of the cleaning member, the paper twists easily around the intermediate transfer body by the combination of the electrostatic force and the high viscosity of the carrier liquid.

In view of the foregoing, one object of the present invention is to provide an image forming apparatus which can properly perform the second transfer without setting ahead the timing for starting the polarity reversal from the reverse transfer bias to the transfer bias. Another object of present invention is to provide an image forming apparatus which could eliminate common problems such as paper jam and second transfer defect caused by setting ahead the timing for starting the polarity reversal.

SUMMARY OF THE INVENTION

In accordance with one aspect of the present invention, an image forming apparatus comprises an image forming portion which forms a toner image on one or plural image bearing members using a liquid developer, with the toner being dispersed in a carrier liquid contained in the liquid developer. The present invention further comprises an intermediate transfer section which has an endless belt and plural rotating bodies. The toner image formed on the image bearing member is first transferred to the endless belt, with the endless belt being stretched and rotated by the rotating bodies. A second transfer roller, which is disposed while facing one of the plural rotating bodies, abuts on the endless belt to form a nip. A first bias applying section which is connected to the second transfer roller is able to apply a transfer bias to the second transfer roller when the toner image on the endless belt is second transferred to a recording medium passing through the nip. The first bias applying section applies a reverse transfer bias to the second transfer roller when the second transfer is not performed, with the reverse transfer bias having an opposite polarity to that of the transfer bias. A second bias applying section, which is connected to the rotating body facing the second transfer roller, applies a bias.

The above and other objects, features, and advantages of the present invention will be more apparent from the following detailed description taken in conjunction with the accompanying drawings.

In this text, terms "comprising", "comprise", "comprises" and other forms of "comprise" can have the meaning ascribed to these terms in U.S. Patent Law and can mean "including", "include", "includes" and other forms of "include".

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which exemplary embodiments of the invention are illustrated in the accompanying drawings in which corresponding components are identified by the same reference numerals.

BRIEF DESCRIPTION OF THE DRAWINGS

The following detailed description, given by way of example, but not intended to limit the invention solely to the specific embodiments described, may best be understood in conjunction with the accompanying drawings, in which.

DETAILED DESCRIPTION OF THE PREFERRED EMBODIMENT

Each example is provided by way of explanation of the invention, and by no way limiting the present invention. In fact, it will be apparent to these skilled in the art that various modifications, combinations, additions, deletions and variations can be made in the present invention without departing from the scope or spirit of the present invention. For instance, features illustrated or described as part of one embodiment can be used in another embodiment to yield a still further embodiment. It is intended that the present invention covers such modifications, combinations, additions, deletions, applications and variations come within the scope of the appended claims and their equivalents.

A preferred embodiment of the present invention will be described below with reference to FIGS. 1 to 8.

Figure 1:
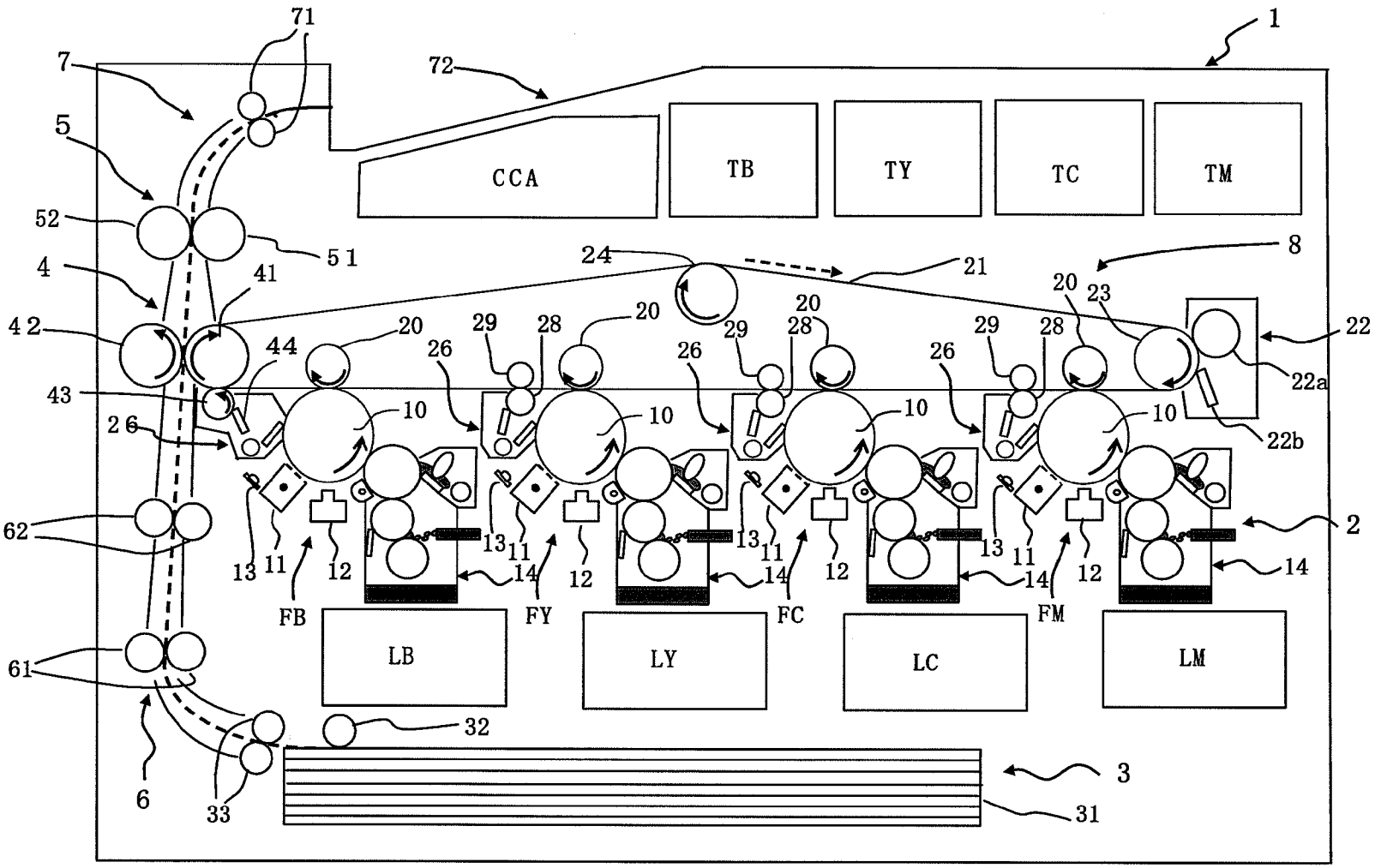
FIG. 1 is an exploded view schematically showing a configuration of a printer according to one embodiment of the present invention.
Figure 2:
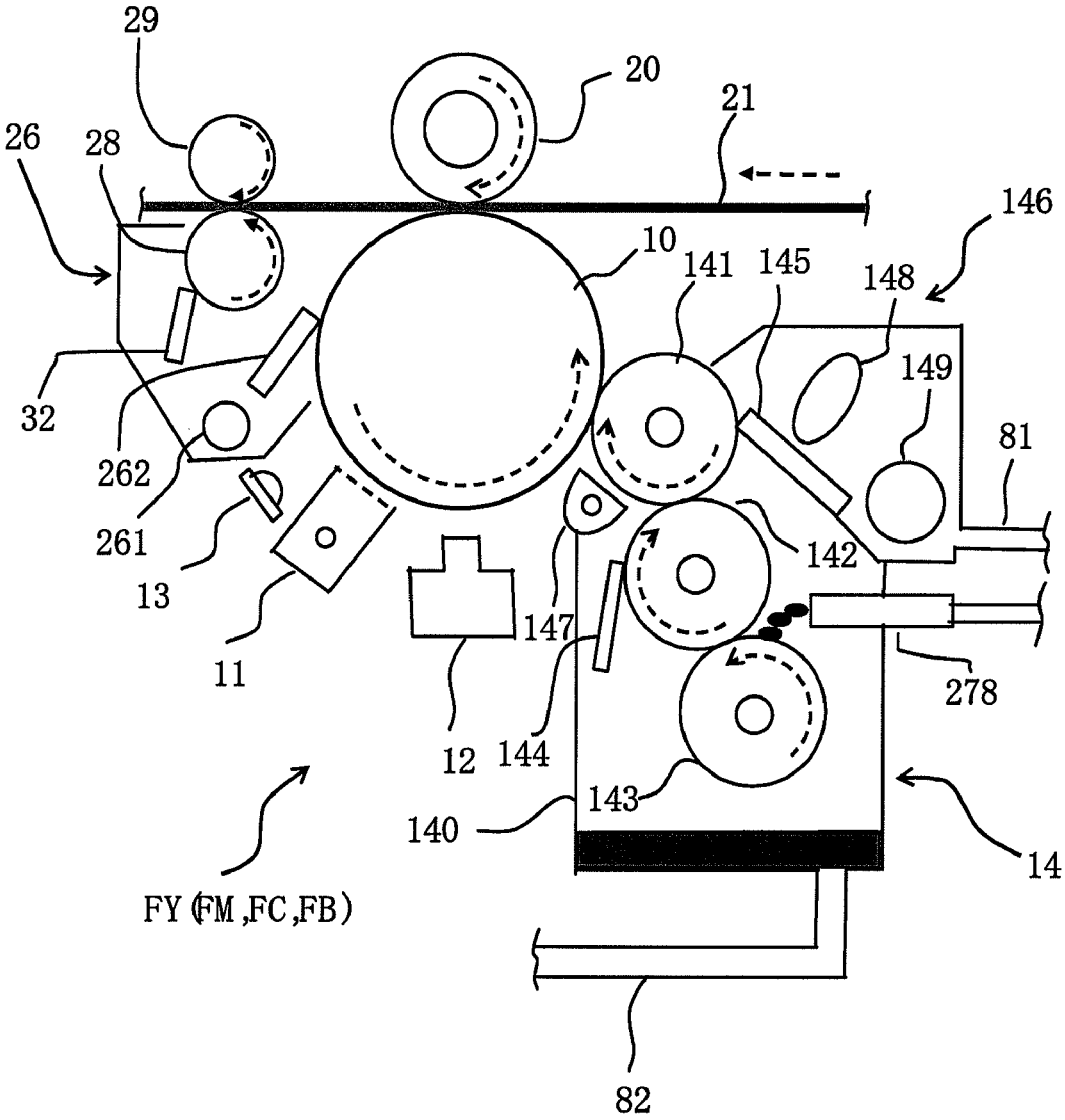
FIG. 2 is an exploded view of one section of FIG. 1 schematically showing an image forming unit according to one embodiment of the present invention.

A structure and an operation of a color printer 1 (corresponding to an image forming apparatus) according to an embodiment of the present invention will be described with reference to FIGS. 1 and 2. FIG. 1 is an exploded view of one embodiment of the present invention showing schematically a configuration of the printer 1 of the embodiment, and FIG. 2 is an exploded sectional view schematically showing an image forming unit according to the embodiment of the present invention shown in FIG. 1.

The color printer 1 comprises an image forming portion 2, a paper storing section 3, a second transfer section 4, a fixing section 5, a paper conveyer section 6, a discharging section 7, and an intermediate transfer section 8. The image forming portion 2 is a tandem type image forming portion which forms a toner image based on the image data. The paper storing section 3 stores a plurality of papers, which is of an example of the recording medium. The second transfer section 4 transfers the toner image formed on the image forming portion 2 onto the paper. The fixing section 5 fixes the transferred toner image onto the paper. The paper conveyer section 6 conveys the paper from the paper storing section 3 to the discharging section 7. The discharging section 7 discharges paper after an image has been fixed on a sheet of the paper. The intermediate transfer section 8 temporarily retains the toner image formed by the image forming portion 2.

The image forming portion 2 includes a plurality of image forming units FB, FY, FC, and FM. Each image forming unit is described in detail later.

The paper storing section 3 stores one or more papers onto which the toner image is to be formed. The paper storing section 3 is disposed in a lower portion of the color printer 1. The paper storing section 3 includes a paper feeding cassette 31 in which one or more papers is stored, a paper feeding roller 32, and a pair of paper separation rollers 33.

The second transfer section 4 transfers the toner image formed on the intermediate transfer belt 21, serving as an endless belt, onto the paper. The second transfer section 4 includes a driving roller 41 which drives the intermediate transfer belt 21 and a second transfer roller 42 which is positioned to face the driving roller 41.

The fixing section 5 fixes the toner image onto the paper, and is disposed above the second transfer section 4. The fixing section 5 includes a heating roller 51 and a pressing roller 52, which is disposed for facing the heating roller 51.

The paper conveyer section 6 includes multiple pairs of conveyer rollers 61, and a pair of regist rollers 62. The paper conveyer section 6 conveys the paper from the paper storing section 3 to the second transfer section 4 and discharging section 6. Although only one pair of conveyer rollers 61 is shown in FIG. 1, other pairs of conveyer rollers are actually arranged in a direction perpendicular to a paper plane in FIG. 1, but are not shown in FIG. 1.

The discharging section 7 discharges the paper onto which the toner image is transferred and fixed, and the discharging section 7 includes at least one pair of discharging roller 71 and a discharging tray 72 provided in an upper surface of the color printer 1. Although only one pair of discharging roller 71 is shown in FIG. 1, other pairs of discharging rollers are actually arranged in the direction perpendicular to the paper plane in FIG. 1, but are not shown in FIG. 1.

The intermediate transfer section 8 includes an intermediate transfer belt 21 serving as an intermediate transfer body, a driving roller 41, a driven roller 23, a tension roller 24, and a belt cleaning device 22. The driving roller 41, the driven roller 23, the tension roller 24 are used to stretch and rotate the intermediate transfer belt 21. The intermediate transfer section 8 can be unitized. The number of rollers is not limited to the example shown in FIG. 1.

The intermediate transfer belt 21 is formed by an endless or loop-shape member having electric conductivity. The intermediate transfer belt 21 is circularly driven clockwise as indicated by the arrow in FIGS. 1 and 2. The intermediate transfer belt 21 is wider than the maximum width of any paper and can accommodate various sizes of papers used in the color printer 1. As used herein, the "width" shall mean a length in a direction perpendicular to the paper conveying direction. Hereinafter, in the intermediate transfer belt 21, a face orientated toward the outside is referred to as the surface side and the other face is referred to as the backside. The intermediate transfer belt 21 is stretched by the driving roller 41, the driven roller 23, and the tension roller 24. The driving roller 41, the driven roller 23 and the tension roller 24 are serving as the rotating bodies. When the driving roller 41 is rotated by a driving motor (not shown), the intermediate transfer belt 21 is driven. When the intermediate transfer belt 21 is driven, the driven roller 23 and the tension roller 24 are rotated in accordance with the rotation of the intermediate transfer belt 21. The tension roller 24 imparts a proper tension to the intermediate transfer belt 21 such that the intermediate transfer belt 21 is taut.

The belt cleaning section 22 cleans the intermediate transfer belt 21. The cleaning section 22 includes a cleaning roller 22*a* and a cleaning blade 22*b*.

The image forming units FY, FM, FC, and FB are located between the cleaning section 22 of the intermediate transfer belt 21 and the second transfer section 4. They are arranged along a line near the intermediate transfer belt 21. The image forming units FB, FY, FC, and FM correspond to colors of Black (Bk), Yellow (Y), Cyan (C), and Magenta (M) respectively. Although the arrangement order of the image forming units FB, FY, FC, and FM are not limited to the configuration of FIG. 1, in consideration of an influence of color mixture on a completed image, it is preferable that the image forming units are arranged as shown in FIG. 1.

As shown in FIG. 2, the image forming unit FY will be described as an example of the image forming unit. The image forming unit FY comprises a photosensitive drum 10 serving as a image bearing member, a electric charging device 11, an exposing device 12, a developing device 14, a first transfer roller 20, a cleaning device 26, a neutralizing device 13, and a carrier liquid removal roller 28. In the image forming units, although the carrier liquid removal roller 28 is not provided in the image forming unit FB located closest to the second transfer section 4, other configurations of the image forming unit FB are similar to those of the image forming units FY, FC, and FM.

Liquid developer circulating devices LY, LM, LC, and LB, toner tanks CB, CY, CC, and CM are provided according to the image forming units FY, FM, FC, and FB, respectively to supply and recover color liquid developers. A carrier tank CCA is provided for supplying a carrier liquid to the each image forming units FY, FM, FC, and FB. The description of each liquid developer circulating device is omitted.

The photosensitive drum 10 is a columnar member and bears the toner image (in the embodiment, the toner is positively charged) on the surface of the photosensitive drum 10. The photosensitive drum 10 can be rotated counterclockwise as shown by a broken-line arrow in FIG. 2.

The electric charging device 11 can evenly charge the surface of the photosensitive drum 10.

The exposing device 12 comprises a light source such as an LED, and the exposing device 12 emits light onto the evenly-charged surface of the photosensitive drum 10 according to the image data fed from an external device. Therefore, an electrostatic latent image is formed on the surface of the photosensitive drum 10.

The developing device 14 holds the liquid developer which includes the toner and liquid carrier such that the liquid developer faces the electrostatic latent image on the surface of the photosensitive drum 10, as a result, the toner attaches itself to the electrostatic latent image. Therefore, the electrostatic latent image is developed as a toner image.

The developing device 14 includes a developing container 140, a developing roller 141, a supply roller 142, a support roller 143, a supply roller blade 144, a developing cleaning blade 145, a developer recovery device 146 and a developing roller charging device 147.

The developing container 140 receives the supply of the liquid developer which includes toner and the liquid carrier. As described later, the liquid developer, with the ratio of the toner with respect to the carrier liquid being preliminarily regulated, is supplied from a supply nozzle 278 into the developing container 140 through a connection pipe 87 connecting the liquid developer circulating device. The liquid developer is supplied toward a portion near a nip portion between the support roller 143 and the supply roller 142. The residual liquid developer falls below the support roller 143, and the residual liquid developer is temporarily stored in a bottom portion of the developing container 140. The stored liquid is recovered through a connection pipe 82 by the liquid developer circulating devices.

The support roller 143 is disposed in the substantially center of the developing container 140. The support roller 143 abuts on the supply roller 142 to form a nip. The supply roller 142 is disposed obliquely above the support roller 143. The supply roller 142 is disposed for shifting from immediately above the support roller 143 toward the direction away from the supply nozzle 278. A groove is provided in a circumferential surface of the supply roller 142 in order to hold the liquid developer. As shown by a broken-line arrow of FIG. 2, the support roller 143 rotates counterclockwise and the supply roller 142 rotates clockwise.

The liquid developer supplied from the supply nozzle 278 is temporarily retained on the upstream side in the rotating direction of the nip formed between the support roller 143 and the supply roller 142, and the liquid developer is conveyed upward while retained in the groove of the supply roller 142 in accordance with the rotations of the rollers 142 and 143. The supply roller blade 144 press contacts the circumferential surface of the supply roller 142, and therefore the supply roller blade 144 regulates the amount of the liquid developer retained on the supply roller 142 such that the liquid developer becomes a predetermined amount. The residual liquid developer scraped away by the supply roller blade 144 is received by the bottom portion of the developing container 140.

The developing roller 141 is disposed in an opening of an upper portion of the developing container 140 so as to be in contact with the supply roller 142. The developing roller 141 is rotated in the same direction as the supply roller 142. That is, in the nip section where the developing roller 141 and the supply roller 142 abut on each other, the surface of the developing roller 141 is moved in the opposite direction to the surface of the supply roller 142. Therefore, the liquid developer retained on the circumferential surface of the supply roller 142 is delivered to the circumferential surface of the developing roller 141. At this point, because a thickness of a liquid developer layer on the supply roller 142 is regulated to a predetermined value, a thickness of a liquid developer layer formed on the surface of the developing roller 141 is also maintained at a predetermined value.

The developing roller charging device 147 moves the toner in the liquid developer layer borne by the developing roller 141 onto the surface side of the developing roller 141 by applying an electric field having the same polarity as the charged toner. Thereby the developing roller charging device 147 improves image developing efficiency. The developing roller charging device 147 faces the circumferential surface of the developing roller 141 on the downstream side of a contact portion between the developing roller 141 and the supply roller 142 in the rotating direction of the developing roller 141 and on the upstream side of a contact portion between the developing roller 141 and the photosensitive drum 10 in the rotating direction of the developing roller 141 so as to apply an electric field.

The developing roller 141 contacts the photosensitive drum 10. The toner image corresponding to the image data is formed on the surface of the photosensitive drum 10 by a potential difference between an electrostatic latent image potential on the surface of the photosensitive drum 10 and a developing bias applied to the developing roller 141 (developing operation).

The developing cleaning blade 145 is disposed on the downstream side of the contact portion between the developing roller 141 and the photosensitive drum 10, and is also disposed on the upstream side of contact portion between the supply roller 142 and the developing roller 141 in the rotating direction of the developing roller 141 thereby the developing cleaning blade 145 contacts the developing roller 141. The developing cleaning blade 145 removes the liquid developer on the surface of the developing roller 141 after the developing operation is performed to the photosensitive drum 10.

The developer recovery device 146 recovers the liquid developer removed by the developing cleaning blade 145. The developer recovery device 146 delivers the liquid developer to the connection pipe 81 of the liquid developer circulating device(s). The liquid developer flows down along the surface of the developing cleaning blade 145. Here, the liquid developer has high viscosity, a delivery roller 148 which assists the delivery of the liquid developer is provided in the developer recovery device 146. The recovered liquid developer is sent in the direction perpendicular to the paper plane of FIG. 2 by a feeding screw 149, and the liquid developer enters the connection pipe 81 connected to the liquid developer circulating device.

The first transfer roller 20 is disposed on the backside of the intermediate transfer belt 21 so that the first transfer roller 20 faces the photosensitive drum 10. A power supply (not shown) applies a voltage having an opposite polarity (by way of example, in the current embodiment, negative polarity), to that of the toner in the toner image, to the first transfer roller 20. That is, the first transfer roller 20 applies the voltage having the opposite polarity to that of the toner to the intermediate transfer belt 21 at the position where the first transfer roller 20 contacts the intermediate transfer belt 21. Because the intermediate transfer belt 21 has conductive properties, the toner is attracted onto the surface side of the intermediate transfer belt 21 by applied voltage.

The cleaning device 26 cleans the liquid developer which is not transferred from the photosensitive drum 10 to the intermediate transfer belt 21 but remains on the photosensitive drum 10. The cleaning device 26 includes a cleaning blade 262 and a residual developer conveyer screw 261.

The cleaning blade 262 scrapes the liquid developer away remaining on the surface of the photosensitive drum 10. The cleaning blade 262 is formed by a plate-shape member extended toward a direction of a rotating shaft of the photosensitive drum 10. An end portion of the cleaning blade 262 contacts the surface of the photosensitive drum 10, and the cleaning blade 262 scrapes away the remaining liquid developer left on the photosensitive drum 10 in accordance with the rotation of the photosensitive drum 10.

The residual developer conveyer screw 261 is disposed in the cleaning device 26. The residual developer conveyer screw 261 conveys the liquid developer which is scraped away from the photosensitive drum 10 by the cleaning blade 262 and stored in the cleaning device 26 or the carrier liquid which is squeegeed down from the carrier liquid removal roller 28 by the cleaning blade 32 (to be described), and stored in the cleaning device 26, to the outside of the cleaning device 26.

The neutralizing device 13 has a light source for neutralization, and the neutralizing device 13 neutralizes the surface of the photosensitive drum 10 with the light emitted from the light source. The neutralizing device 13 performs the neutralization for preparing the next image formation after the cleaning blade 262 removes the remaining liquid developer from the surface of the photosensitive drum 10.

The carrier liquid removal roller 28 is a substantially cylindrical member which can be rotated about a rotating shaft parallel to the rotating shaft of the photosensitive drum 10. The carrier liquid removal roller 28 is rotated in the same direction as the photosensitive drum 10. The carrier liquid removal roller 28 is disposed in the second transfer section side in relation to the contact position between the photosensitive drum 10 and the intermediate transfer belt 21 so that it removes the carrier liquid from the surface of the intermediate transfer belt 21. The carrier liquid removal roller 28 removes the excess carrier liquid to improve the efficiency of the first transfer in the downstream-side image forming unit. The efficiency of the removal of the carrier liquid is improved by nipping the intermediate transfer belt 21 between the carrier liquid removal roller 28 and an opposed roller 29. An electric field is formed between the carrier liquid removal roller 28 and the opposed roller 29 such that the toner image formed on the intermediate transfer belt 21 does not adhere to the carrier liquid removal roller 28. The carrier liquid moved from the intermediate transfer belt 21 to the carrier liquid removal roller 28 is scraped down into the cleaning device 26 by the cleaning blade 32 of the carrier liquid removal roller 28. The carrier liquid removal roller 43 (described later), also has a function of improving the efficiency of the second transfer. The carrier liquid moved from the intermediate transfer belt 21 to the carrier liquid removal roller 43 is scraped down into the cleaning device 26 of the image forming unit FB by cleaning blade 44 of the carrier liquid removal roller 43.

Figure 3:
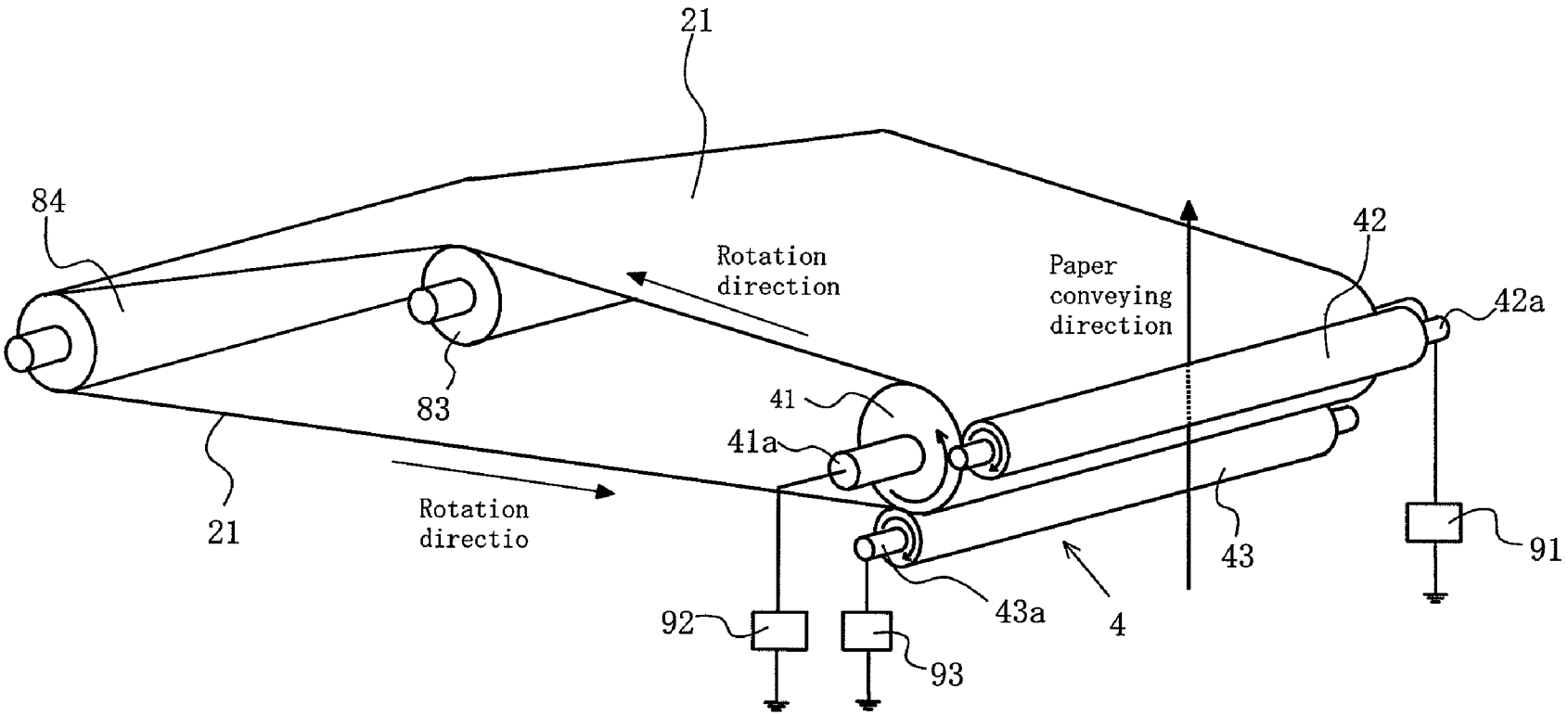
FIG. 3 is a perspective view showing a second transfer section according to another embodiment of the present invention.

The second transfer section 4 of another embodiment according to the present invention will be described below with reference to FIGS. 3 and 4. FIG. 3 is a perspective view showing the second transfer section 4 of the embodiment. In FIG. 3, the image forming section 2 is not shown in this figure.

On the right side of FIG. 3, the second transfer roller 42 and the carrier liquid removal roller 43 are positioned such as to abut on the surface side of the intermediate transfer belt 21. Both the second transfer roller 42 and the carrier liquid removal roller 43 face the driving roller 41 which keeps the intermediate transfer belt 21 taut. Axis line directions of a roller shaft 42*a* of the second transfer roller 42, a roller shaft 43*a* of the carrier liquid removal roller 43, and a roller shaft 41*a* of the driving roller 41 are parallel to one another. Roller shafts 41*a*, 42*a*, and 43*a* are rotatably supported by bearings (not shown) and the like.

The second transfer roller 42 is provided is shown to the right in FIG. 3. The second transfer roller 42 abuts the intermediate transfer belt 21, which is stretched by the driving roller 41 and the like. A nip is formed between the intermediate transfer belt 21 and the second transfer roller 42. The pair of resist rollers 62 synchronizes timing to guide the paper to enter the nip at the same time when the toner image also reaches the nip (paper conveying direction is shown in FIG. 3). A predetermined voltage (current) having the opposite polarity to the polarity (for example, in the embodiment, positive polarity) of the toner is applied to the second transfer roller 42, whereby the toner is transferred to the paper a second time when the paper passes through the nip.

A first bias applying section 91 is provided as a bias applying part for applying a bias to the second transfer roller 42. In other words, the first bias applying section 91 is provided as an electric power supply for applying the voltage (current) to the second transfer roller 42. The first bias applying section 91 and the second transfer roller 42 are connected to each other, and a predetermined voltage (current) is applied to the second transfer roller 42 from the first bias applying section 91. Although described in detail later, the first bias applying section 91 can apply the voltages (currents) having positive and negative polarities to the second transfer roller 42.

In the embodiment, a second bias applying section 92 is also provided as a part for applying the bias to the driving roller 41 serving as a rotating body. In other words, the second bias applying section 92 is provided as the electric power supply for applying the voltage (current) to the driving roller 41. The second bias applying section 92 and the driving roller 41 are connected to each other, and a predetermined voltage (current) is applied to the driving roller 41 from the second bias applying section 92. Although described in detail later, the second bias applying section 92 can apply the bias having the positive polarity to the driving roller 41.

In FIG. 3, the carrier liquid removal roller 43 is disposed below the driving roller 41 so that the carrier liquid removal roller 43 faces the driving roller 41. The carrier liquid removal roller 43 removes the carrier liquid included in the toner image on the intermediate transfer belt 21 or the carrier liquid adhering to the intermediate transfer belt 21, and sometimes the carrier liquid removal roller 43 is also called squeegee roller. One embodiment of the present invention has a feature in which the carrier liquid removal roller 43 is provided so that the carrier liquid removal roller 43 faces the driving roller 41. The feature will be described in detail with reference to FIG. 4. The carrier liquid removal roller 41 plays a roll in improving the efficiency of the second transfer by removing any excess carrier liquid.

Figure 4A:
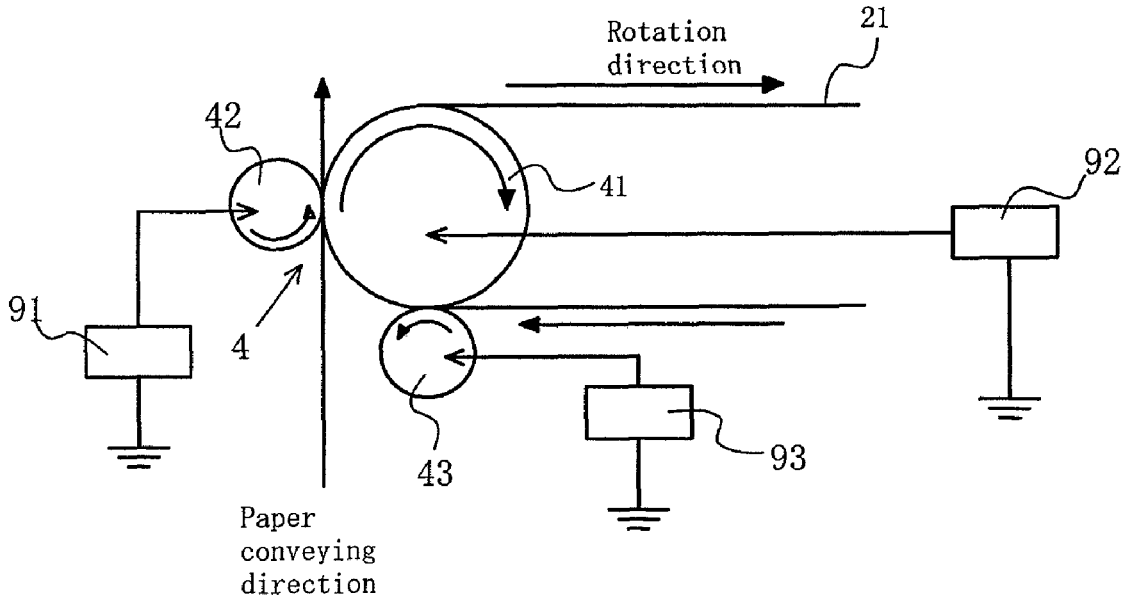
FIGS. 4A and 4B are each an exploded sectional view schematically showing a second transfer section, with FIG. 4A showing the second transfer section according to a further embodiment of the present invention and, in contrast, FIG. 4B showing a conventional second transfer section.
Figure 4B:
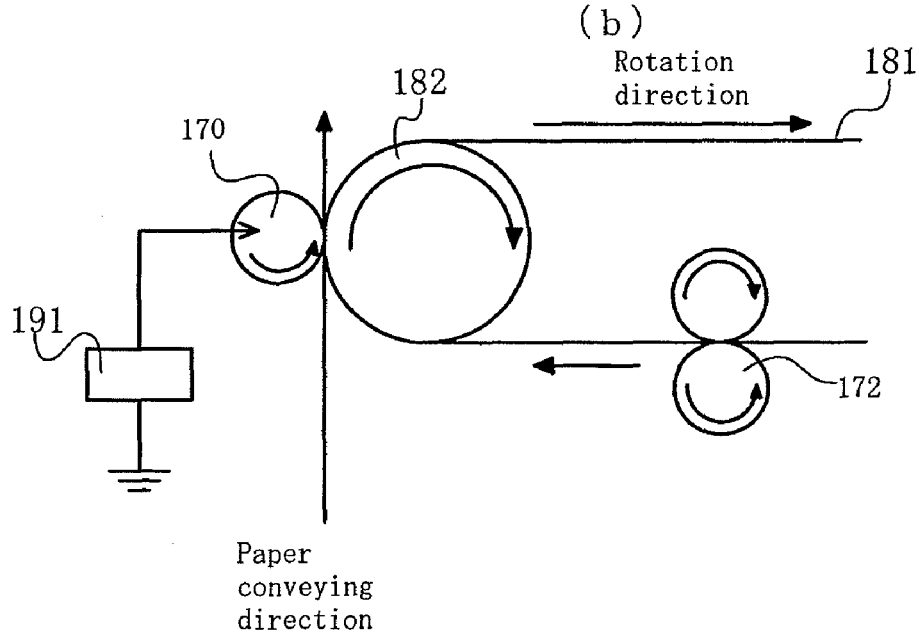
FIG. 4B (Prior Art)

FIG. 4 is an exploded sectional view schematically showing the second transfer section 4 of the embodiment. FIG. 4A shows the second transfer section 4 of the embodiment, and FIG. 4B shows a conventional second transfer section.

As shown in FIG. 4B, in the second transfer section of a conventional image forming apparatus, the second transfer roller 170 (a bias applying section 191 is connected to the second transfer roller 170 to apply the bias for the second transfer) is supported such that the second transfer roller 170 is pressed against the driving roller 182 so as to sandwich an intermediate transfer belt 181 therebetween. On the other hand, conventionally the carrier liquid removal rollers 172 are provided as a pair of rollers between the image forming unit FB which is disposed closest to the second transfer roller 170 among image forming units and the second transfer roller 170. Accordingly, when the carrier liquid removal roller 43 is provided according to an embodiment of present invention, one roller can be eliminated. Space saving, printer size reduction, simplification, and cost reduction are among the many advantages that can be achieved in the image forming apparatus of the printer 1 in accordance with the present invention.

In a printer according to an embodiment of the present invention, the second bias applying section 92 is connected to the driving roller 41. The second bias applying section 92 applies the voltage having the positive polarity to the driving roller 41. At this point in the embodiment, because the toner is charged with a positive polarity, in the case that the electric potential of the carrier liquid removal roller 43 is grounded, similar to a conventional technique, an electric field is formed such that the toner is moved from the driving roller 41 to the carrier liquid removal roller 43. Then possibly a part of the toner image on the surface of the intermediate transfer belt 21 is moved and adheres to the carrier liquid removal roller 43. Therefore, in an embodiment of present invention, a third bias applying section 93 is provided to apply a bias to the carrier liquid removal roller 43. Because it is only necessary to prevent the movement of the toner, the bias applied to the carrier liquid removal roller 43 by the third bias applying section 93 has the same electric polarity (for example, in this embodiment, positive polarity) as the bias applied by the second bias applying section 92. The third bias applying section 93 applies the bias having a voltage whose value is greater than or equal to the value of the voltage of the bias applied by the second bias applying section 92.

In the case of the use of the toner having negative polarity, because the second bias applying section 92 applies a negative polarity bias, it is necessary that the third bias applying section 93 apply a bias with the same electric polarity (negative polarity) as the bias applied by the second bias applying section 92. In addition the third bias applying section 93 applies a bias having a voltage whose value is less than or equal to the value of the voltage of the bias applied by the second bias applying section 92. In general, it is necessary that the bias applied by the third bias applying section 93 have the same electric polarity as the bias applied by the second bias applying section 92, and a voltage whose absolute value is more than or equal to the absolute value of the voltage of the bias applied by the second bias applying section 92.

Each of the first bias applying section 91, the second bias applying section 92, and the third bias applying section 93 boosts the voltage supplied from the power supply device 104, which is connected to a commercial power source and the like to produce an optimum bias voltage (current) and applies the bias.

Figure 5:
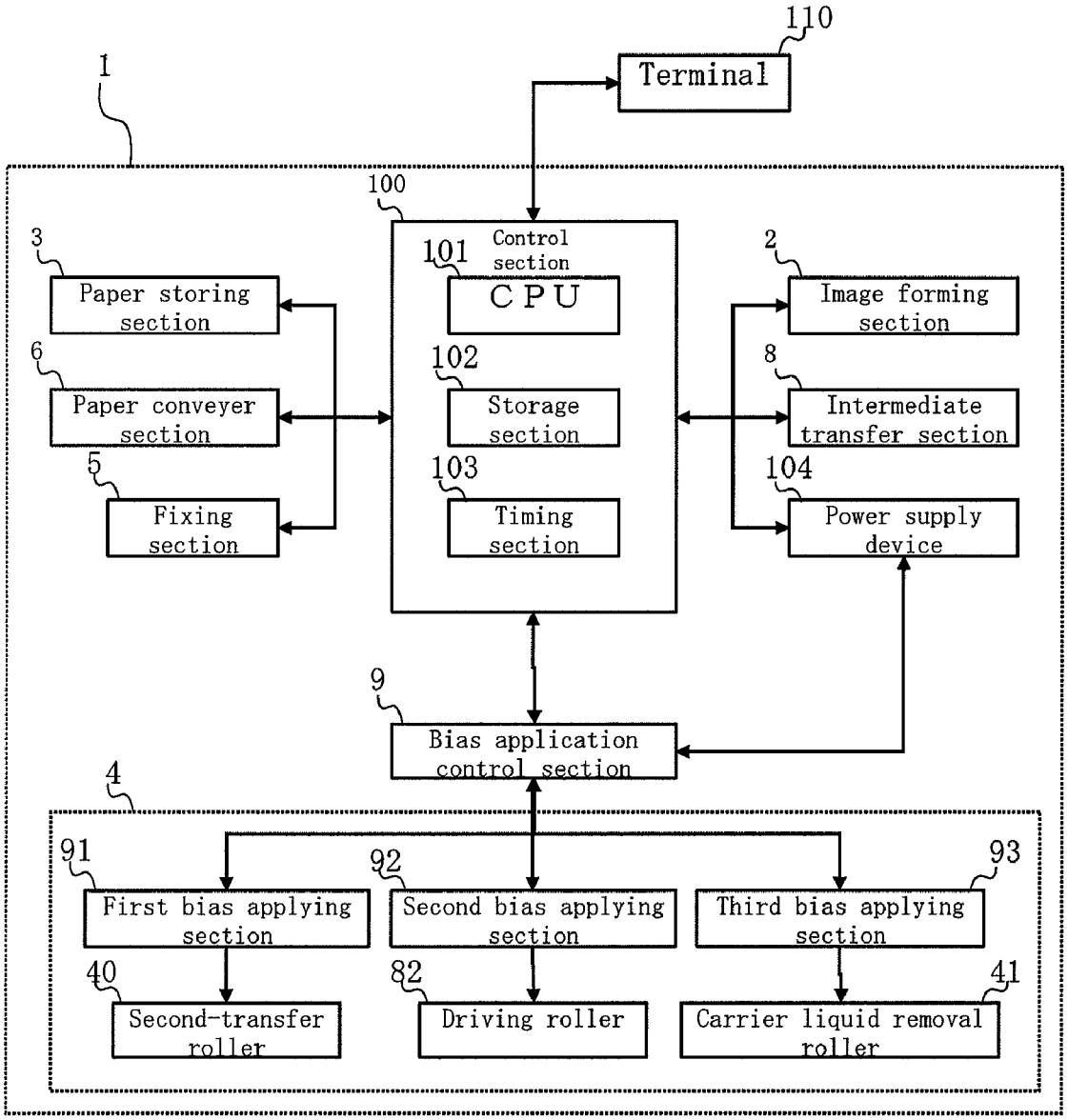
FIG. 5 is a block diagram showing the printer according to a still further embodiment of the present invention.

A hardware configuration of the printer 1 according to an embodiment of the present invention will be described below with reference to FIG. 5. FIG. 5 is a block diagram showing printer 1 of the embodiment in accordance with the present invention.

As shown in FIG. 5, printer 1 is connected to one or more terminals 110 (for example, a personal computer, though only one terminal is shown in FIG. 5 for the sake of convenience) through a network, and printer 1 receives transmission of the image data from the terminal 110 and forms an image.

A control section 100 is provided to control an image forming operation of printer 1. As shown in FIG. 5, the control section 100 is connected to the second transfer section 4 and intermediate transfer section 8 and the like which constitute printer 1. Control section 100 controls the second transfer section 4 and the intermediate transfer section 8 and the like. Control section 100 includes CPU 101, a storage section 102, and a timing section 103 and the like.

CPU 101 is a central processing unit which transmits a control signal to each section of printer 1 and performs computation based on a control program or control data. The storage section 102 includes but is not limited to ROM (Read Only Memory), RAM (Random Access Memory), HDD (Hard Disk Drive) and a flash ROM and the like. ROM, HDD, and the flash ROM are nonvolatile memories in which the control program, the control data, and the image data are stored. RAM is a volatile memory in which CPU 101 expands the control program, the control data, and the image data to perform the computation and temporarily store the control program, the control data, and the image data and the like.

The power supply device 104 shown in FIG. 5 is connected to a commercial power supply to supply various voltages to the sections of printer 1. Therefore, the power supply device 104 rectifies an alternating-current voltage into a direct-current voltage of 24V to supply electric power to various motors in the printer 1. The power supply device 104 steps down the voltage to necessary voltages such as 5V and 3.3V to drive electronic components such as the control section 100. The power supply device 104 boosts the voltage used to supply the bias voltages for the first transfer and second transfer to the bias applying sections.

For the bias supplied from the power supply device 104 and boosted by each bias applying section, the bias application control section 9 performs ON/OFF control of the bias applied to the second transfer roller 42 by the first bias applying section 91, the bias applied to the driving roller 41 by the second bias applying section 92, and the bias applied to the carrier liquid removal roller 43 by the third bias applying section 93. The bias application control section 9 is connected to CPU 101 so that the bias application control section 9 conducts communication with CPU 101 and receives an operational instruction from CPU 101. Alternatively, CPU 101 may perform the control without providing the bias application control section 9.

Figure 6:
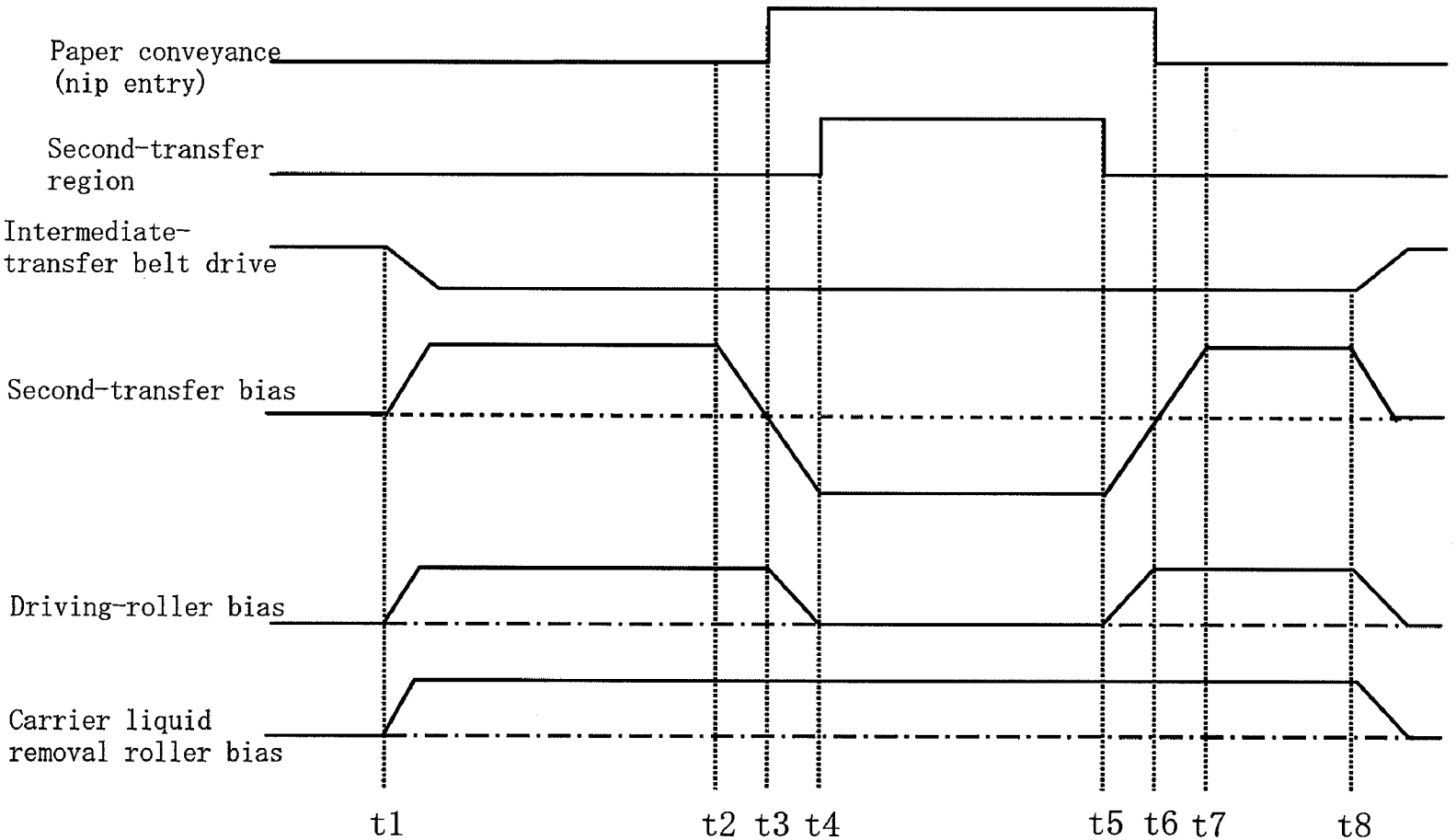
FIG. 6 is a timing chart showing a second transfer bias application according to yet a further embodiment of the present invention.
Figure 7:
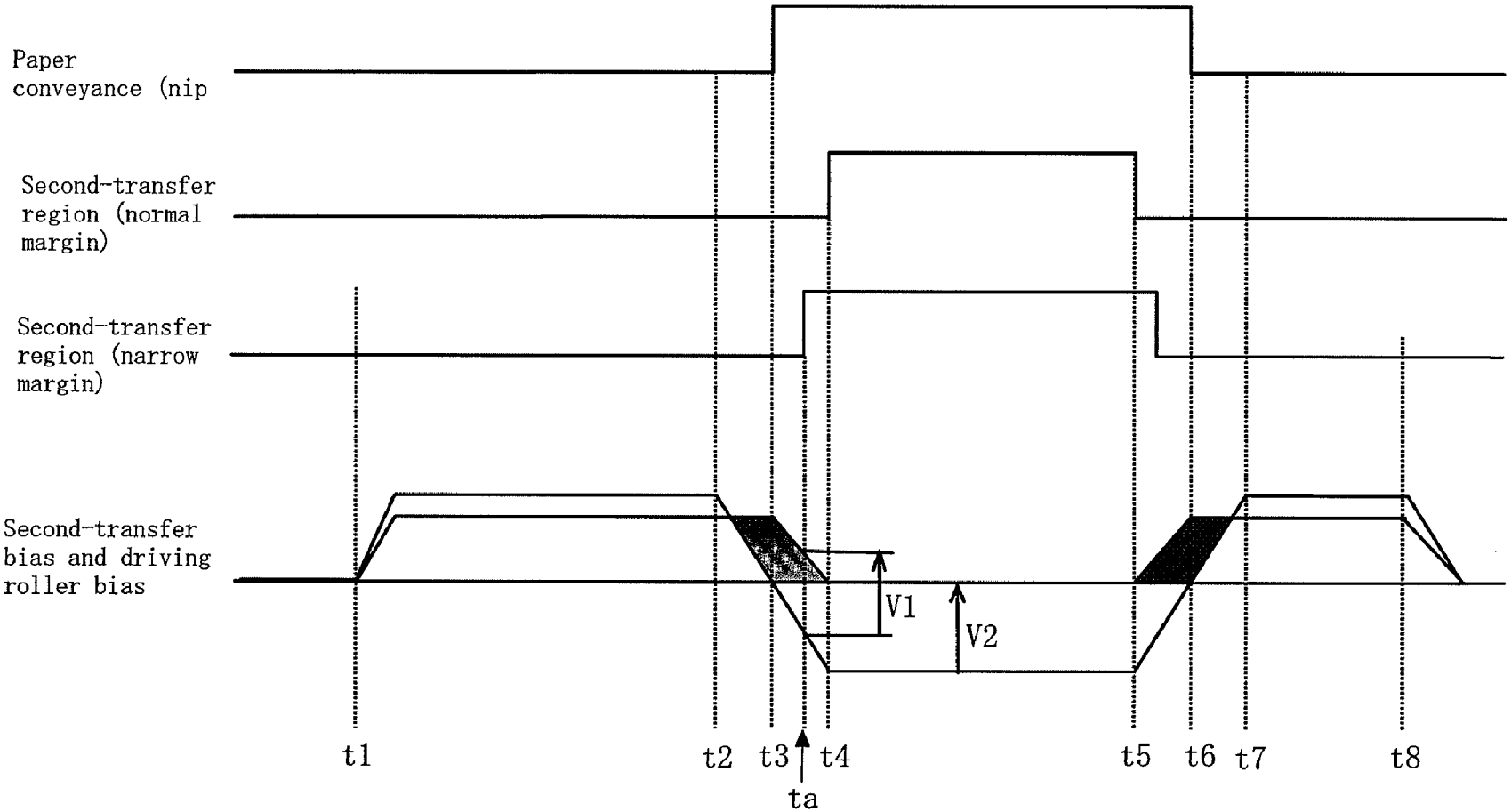
FIG. 7 is a timing chart explaining the characteristics of the second transfer section according to another further embodiment of the present invention.
Figure 8:
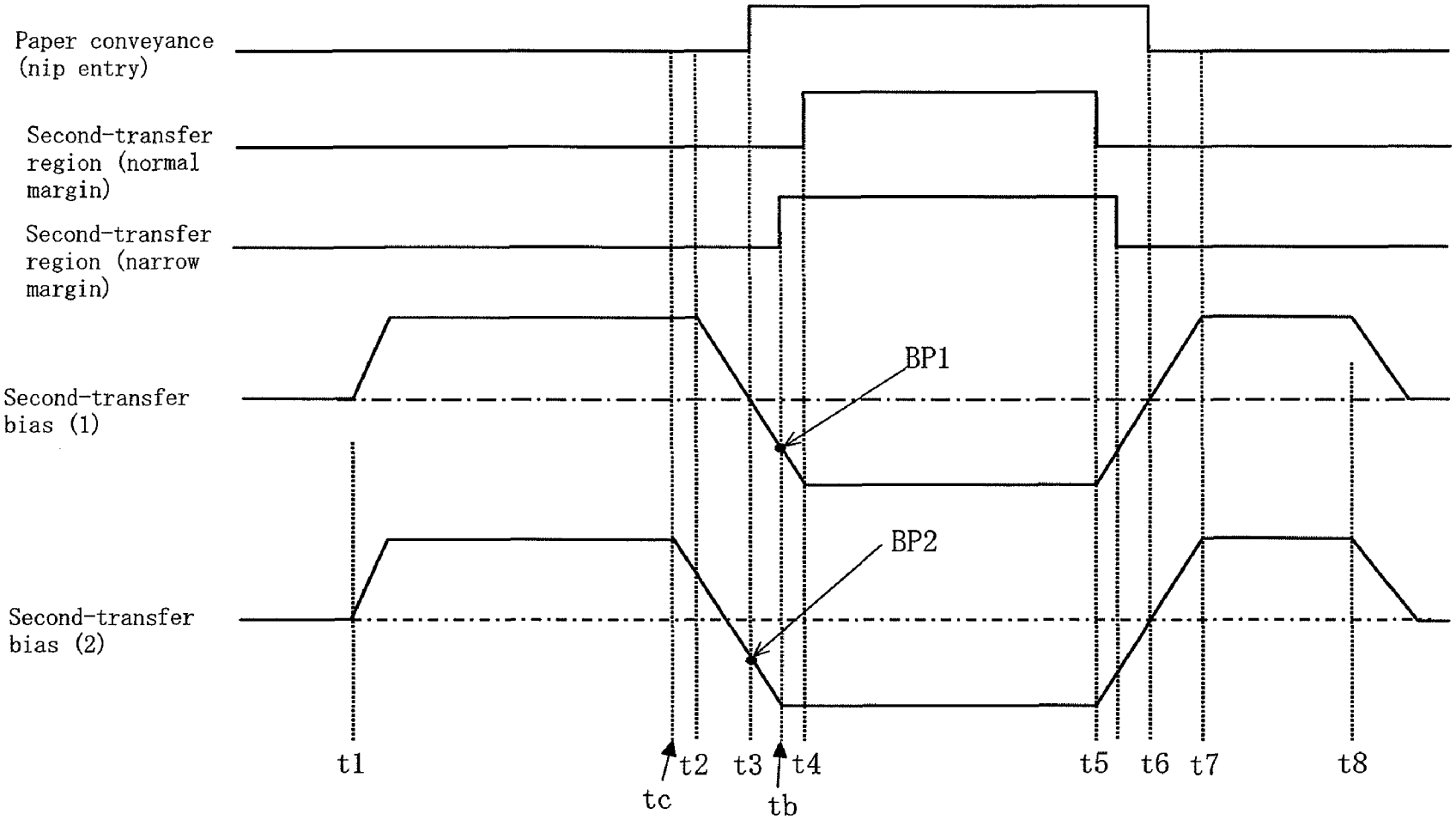
FIG. 8 (Prior Art)
FIG. 8 shows a timing chart of a second transfer bias application in a conventional image forming apparatus.
Figure 9A:
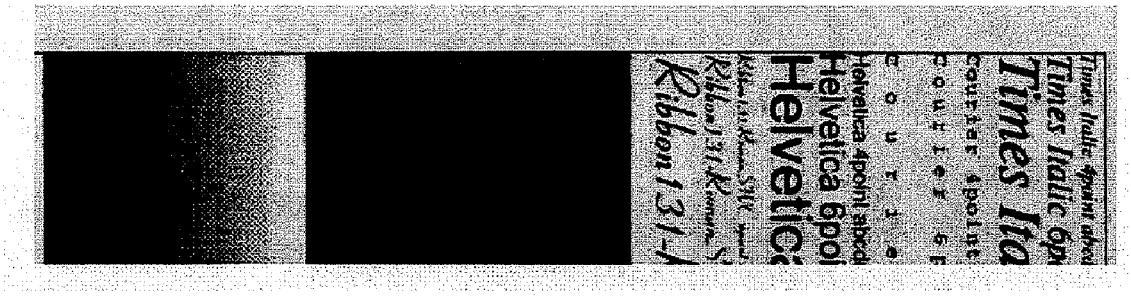
FIG. 9A shows the formation of an image resulting in the case of a small margin portion in the embodiment of the present invention.
Figure 9B:
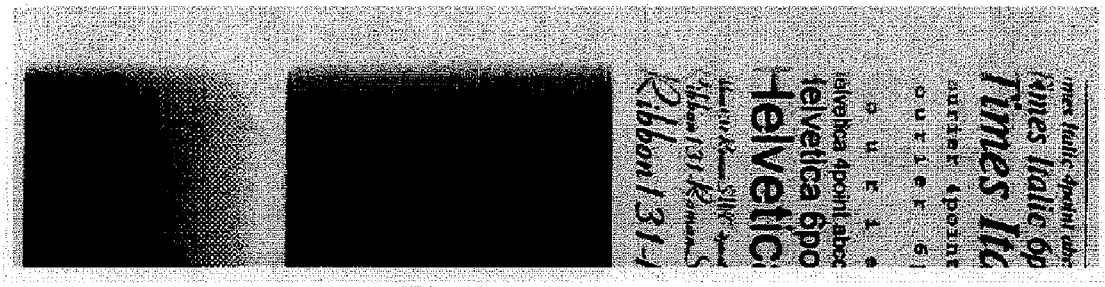
FIG. 9B (Prior Art)
FIG. 9B shows image formation result in the case of a small margin portion in a conventional art.

The second transfer bias application control for the second transfer in the embodiment will be described below with reference to FIGS. 6 to 9. FIG. 6 is a timing chart of the bias application for the second transfer of yet another embodiment in accordance with the present invention. FIG. 7 is a timing chart for explaining characteristics of the second transfer of the embodiment in accordance with the present invention. FIG. 8 is a timing chart of the bias application for the second transfer in a conventional image forming apparatus. FIG. 9A shows an image formation result from an image having a small margin in the embodiment of the present invention, and FIG. 9B shows image formation result from an image having a small margin in a conventional technique. As can be seen from the attached drawings, FIG. 9A does not have any fade out at the left edge of the paper as compared to FIG. 9B. This clearly demonstrates the superior quality of the present invention.

The basic bias application control for the second transfer of printer 1 of the embodiment will be described with reference to FIG. 6.

The line designated as "paper conveyance (nip entry)" in FIG. 6 indicates that, in a High state, the paper is passing through the nip between the second transfer roller 42 and the intermediate transfer belt 21 (more specifically, the plane including the axle of the second transfer roller 42 and the axle of the driving roller 41, hereinafter referred to as "second transfer nip" for the sake of convenience). On the contrary, in a Low state, the line shown by "paper conveyance (nip entry)" indicates that the second transfer roller 42 and the intermediate transfer belt 21 are in direct contact each other.

A line designated as "second transfer region" indicates that, in the High state, the toner image first transferred onto the intermediate transfer belt 21 is passing through the second transfer nip by the rotation of the intermediate transfer belt 21. On the other hand, in the Low state, the line shown by "second transfer region" indicates that the toner image is not passing through the second transfer nip. Accordingly, in order to ensure proper transfer of the toner image onto the paper during the second transfer, it is necessary that the line designated as the second transfer region in the High state falls within a time interval (t3 to t6) during which the line designated as the paper conveyance (nip approach) is in the High state.

A line designated by "intermediate transfer belt drive" indicates that the rotary drive of the intermediate transfer belt 21 begins when the transition from the High state to the Low state starts. The line designated as an "intermediate transfer belt drive" indicates that, when the transition from the Low state to the High state begins after the intermediate transfer belt 21 reaches a constant speed (Low state), the supply of the electric power to the motor for rotating the driving roller 41 is turned off, and the rotary drive of the intermediate transfer belt 21 is stopped (High state) after the intermediate transfer belt 21 goes slightly around by inertia. In other words, the supply of the electric power to the motor for rotating the driving roller 41 is indicated by negative logic, and the supply of the electric power to the motor is turned off when the line shown by "intermediate transfer belt drive" is in the High state.

A line designated as a "second transfer bias" indicates that the transition of the bias applied to the second transfer roller 42 by the first bias applying section 91. A positive bias voltage (hereinafter referred to as "reverse transfer bias") higher than the electric potential of the intermediate transfer belt 21 (driving roller 41) is applied to the second transfer roller 42 in the case where the second transfer is not performed to the paper. This is in order to prevent the contamination of the second transfer roller 42 due to the adhesion of the toner remaining on the intermediate transfer belt 21, because the toner is positively charged in the present embodiment being described. On the other hand, in the case where the second transfer is performed, the first bias applying section 91 applies the negative voltage (current) (hereinafter referred to as "transfer bias") to the second transfer roller 42 to form the electric field such that the toner is moved from the driving roller 41 (intermediate transfer belt 21) toward the direction of the second transfer roller 42, and the toner image is transferred to the paper a second time. An electric potential expressed by an alternate long and short dash line is about ground level. In the case of the use of the negatively-charged toner, the first bias applying section applies a positive bias whose electric potential is higher than that of the driving roller 41 for the transfer bias, and the first bias applying section applies a negative bias whose electric potential is lower than that of the driving roller 41 for the reverse transfer bias.

At this point, the transfer bias of the second transfer roller 42 becomes several negative kilovolts. Actually, from the standpoint of easy control, constant current control is performed such that a constant current is passed through the second transfer roller 42 in applying the transfer bias. For the reverse transfer bias, the biases applied to the driving roller 41 and the carrier liquid removal roller 43, constant voltage control is performed such that a constant voltage is applied. At this point, the actual current passed through the second transfer roller 42 is set to a positive multiple of ten microamperes (for example, about +20 μA).

A line designated as a "driving roller bias" indicates the transition of the bias applied to the driving roller 41 by the second bias applying section 92 (hereinafter referred to as "driving roller bias"). As shown in FIG. 6, the present invention has the feature such that, by applying the driving roller bias which has positive electric polarity, the image can be formed without lacking the leading end portion of the image even if the image to be formed has a narrow (small) margin portion. The feature of the invention is described in detail later. The electric potential expressed by the alternate long and short dash line is the ground.

A line designated as a "carrier liquid removal roller bias" indicates the transition of the bias applied to the carrier liquid removal roller 43 by the third bias applying section 93 (hereinafter referred to as "carrier liquid removal roller bias"). The voltage is applied to the carrier liquid removal roller 43 such that the toner is not moved to the carrier liquid removal roller 43. Because the toner is positively charged in the embodiment, the carrier liquid removal roller bias has the positive electric polarity as shown in FIG. 6. The electric potential expressed by the alternate long and short dash line is the ground.

A magnitude correlation among the biases will be described below while the actual figures are given.

For example, the reverse transfer bias applied to the second transfer roller 42 can be set in a range of about +500V to about +800V. On the other hand, for example, the driving roller bias can be set in a range of about +200 to about +400V, preferably about +300V. That is, the reverse transfer bias applied to the second transfer roller 42 is set larger than the driving roller bias (for example, about +600V), whereby the adhesion to the second transfer roller 42 of the toner remaining on the intermediate transfer belt 21 can be prevented when the second transfer is not performed.

When the driving roller bias is set to about +300V, the carrier liquid removal roller bias is set to more than or equal to +300V in order to prevent the movement of the toner image to the carrier liquid removal roller 43. The carrier liquid removal roller bias can appropriately be set to an extent in which the movement of the toner is not generated according to the driving roller bias.

The second transfer operation of the printer 1 according to an embodiment of the present invention will be described in time series with reference to the timing chart of FIG. 6.

When the image forming instruction is provided to the printer 1 from the terminal 110, the printer 1 uses the image forming section 2 and the intermediate transfer section 8 to first transfer the toner image to the intermediate transfer belt 21. Therefore, the rotary drive of the intermediate transfer belt 21 is started at a time t1 in FIG. 6. That is, the rotation of the driving roller 41 is started. At time t1 in FIG. 6, the bias application control section 9 simultaneously controls each bias applying sections to start the bias application such that the first bias applying section 91 applies the reverse transfer bias (positive electric polarity) to the second transfer roller 42, the second bias applying section 92 applies the driving roller bias (positive electric polarity) to the driving roller 41, and the third bias applying section 93 applies the carrier liquid removal roller bias (positive electric polarity) to the carrier liquid removal roller 43.

Before the full-color toner images formed by a superimposed manner on the intermediate transfer belt 21 enters the second transfer nip, the bias application control section 9 starts to reverse the electric polarity of the bias applied by the first bias applying section 91 at time t2. Because of the time required for the bias current (transfer bias) to reach a value necessary to perform the second transfer, the reversal of the electric polarity of the bias is performed at a time t2 such that the current of the second transfer bias reaches high enough current (voltage) to perform the second transfer when the toner image enters the second transfer nip (the second transfer region becomes the High state). Specifically, the transition time in FIG. 6 is ranged from t2 to t4 (from the polarity reversal to the settled-down state). At the time t2, the driving roller bias is still applied.

At time t3 the paper entry to the second transfer nip begins, and the bias application control section 9 turns off the driving roller bias. The driving roller bias attenuates to the ground with time.

Then, at time t4 the toner image reaches the second transfer nip, as shown in FIG. 6, and the bias current (voltage) applied to the second transfer roller 42 becomes high enough to perform the second transfer (negative polarity). Therefore, the toner image is transferred well to the paper at a second time.

At time t5 the second transfer ends, the reverse transfer bias to the second transfer roller 42 and the driving roller bias start to apply.

When the image formation ends, the bias application control section 9 turns off all the bias applications at time t8 the rotation of the driving roller 41 stops.

Usability of the bias voltage application to the driving roller 41 will be described with reference to FIGS. 7 to 9.

Referring to FIGS. 7 and 8, as described above with reference to FIG. 6, the part of the High state in the chart of "second transfer region (normal margin)" indicates the second transfer region in the case where the second transfer bias applied to the second transfer roller 42 reaches the value necessary to perform the second transfer until the toner image enters the second transfer nip even if the bias voltage is not applied to the driving roller 41.

In FIGS. 7 and 8, the chart of "second transfer region (narrow margin)" indicates the case in which the toner image enters the second transfer nip immediately after the paper enters the second transfer nip because the toner image has a small margin portion (large print area). The chart of "second transfer region (narrow margin)" also corresponds to not only the case in which the margin is actually small in the paper but also the case in which the image forming speed is enhanced so that the margin portion becomes relatively narrow.

The problem in the conventional image forming apparatus will be described with reference to FIG. 8. In FIG. 8, the chart for "second transfer bias (1)" indicates the case in which the second transfer bias applied to the second transfer roller 42 is normally controlled. That is, the chart for "second transfer bias (1)" indicates the second transfer bias application control such that the transfer bias reaches a current (voltage) high enough to perform the second transfer at time (t4) when the second transfer region (normal margin) becomes the High state.

In printers using the conventional bias control of FIG. 8, when the margin of the image is narrowed such as shown in the chart indicated as a "second transfer region (narrow margin)", even if the second transfer region becomes the High state (this time is indicated by tb in FIG. 8), the transfer bias has not reached the value to perform the second transfer properly as shown by a dot BP1 in FIG. 8. Therefore, the second transfer is insufficiently performed, and the image formed has a leading end portion that is lacking. FIG. 9B shows an actual example. In FIG. 9B, the second transfer is insufficiently performed in the leading end portion of the formed image, and density of the image is gradually increased. This shows that, in the conventional image forming apparatus, the necessary transfer bias has not been applied at the time the toner image enters the second transfer nip in the case of the narrow margin or in the case of the enhanced image forming speed.

It seems that it is necessary to shorten the transition time (t2 to t4) which is from the reverse transfer bias to the second transfer bias. However, because the second transfer bias has several negative kilovolts, the transition time is hardly shortened, and the cost is possibly increased.

Therefore, conventionally, as shown in the chart for "second transfer bias (2)" in FIG. 8, the start of the electric polarity reversal from the reverse transfer bias to the second transfer bias is set ahead in order to prevent the lack of the leading end portion of the image in the case that the image has the narrow margin portion (this point is indicated by tc in FIG. 8). However, if above mentioned electric polarity reversal is done, as shown by a dot BP2 of FIG. 8, the electric potential at the second transfer roller 42 becomes lower than that of the driving roller 41 before the paper reaches the second transfer nip (before t3). Therefore, in the conventional manner, because the starting timing for the electric polarity reversal is set ahead, when the sheet enters the second transfer nip, the large difference in the electric potential may occur between the driving roller 41 and the second transfer roller 42. Moreover, after the sheet enters the second transfer nip, because of the large difference in the electric potential continues and the carrier liquid having a high viscosity adheres on the second transfer roller 42 or the intermediate transfer belt 21, the paper having a static charge by friction and the like in conveyance may easily twist around the second transfer roller 42 or the intermediate transfer belt 21. The twisting around of the paper may be the cause of paper jam.

The large difference in the electric potential may cause the residual toner on the intermediate transfer belt 21 to adhere easily to the second transfer roller 42 and contaminate the second transfer roller 42. Accordingly, to form an image having a narrow margin portion, in the case that the start of the polarity reversal is set ahead, many adverse effects such as the paper jam or the contamination of the second transfer roller 42 are generated even if the image is properly formed without lacking the leading end portion. In "second transfer bias (1)" and "second transfer bias (2)" in FIG. 8, the alternate long and short dash line indicates the ground because the bias is not applied to the driving roller 41 in the conventional technique.

The present invention remedies the deficiencies of the adverse effects at once and will be described with reference to FIG. 7.

The lines indicated as "second transfer bias and driving roller bias" in FIG. 7 are the same lines as in FIG. 6 except that the lines are enlarged and superimposed on top of each other. The hatched area in FIG. 7 indicates a difference between the second transfer bias and the driving roller bias, which is still applied to the driving roller 41 after the electric polarity of the bias applied to the second transfer roller 42 starts to reverse. Thus, because the driving roller bias (positive polarity) is applied after the electric polarity of the bias applied to the second transfer roller 42 starts to reverse (positive to negative), the difference in the electric potential between the driving roller 41 and the second transfer roller 42 can be enlarged compared with the case in which the driving roller bias is not applied (FIG. 8).

In other words, compared with the conventional technique in FIG. 8, the difference in the electric potential difference between the second transfer roller 42 and the driving roller 43 in FIG. 7 can be enlarged in the time between t3 and ta. This occurs after the paper enters the second transfer nip. As shown in FIG. 7, even without setting ahead the start of the polarity reversal of the bias applied to the second transfer roller 42, the bias application control section 9 starts the electric polarity reversal of the second transfer bias for the image having the narrow margin at the same timing as the case the bias application control section 9 starts the electric polarity reversal of the second transfer bias for an image having the sufficient margin. The electric potential has a large enough difference to properly ensure the second transfer is performed. That is, for the image having the narrow margin, the bias application control section 9 starts the electric polarity reversal of the second transfer bias at the same time as in the case when the bias application control section 9 starts the electric polarity reversal of the second transfer bias for the image having sufficient margin. As shown in FIG. 7, an electric potential difference V1 between the second transfer roller 42 and the driving roller 41 at time ta can come to an electric potential difference V2 (the state in which the bias enough to perform the second transfer is applied) between the times t4 and t5. Accordingly, all above mentioned adverse effects caused by setting ahead the timing of the electric polarity reversal are eliminated. Additionally, as shown in FIG. 9A, the leading end portion of the image is not lacking, even in the case when the image has a narrow margin.

Thus, in the configuration according to another embodiment of the present invention, the second bias applying section 92 applies the bias having the same polarity as the reverse transfer bias during the polarity reversal transition time from the reverse transfer bias to the transfer bias of the first bias applying section 91. This allows the potential difference to be enlarged between the second transfer roller 42 and the rotating body facing the second transfer roller 42. Therefore, the image forming speed is enhanced and the formation of an image lacking a leading end portion can be prevented when the image has a small margin even if the second transfer time is shortened. That is, the potential difference between the second transfer roller 42 and the driving roller 41 facing the second transfer roller 42 can be controlled.

The carrier liquid removal roller 43 which removes the carrier liquid from the superimposed toner images is formed by a pair of rollers such that the pair of rollers nips the intermediate transfer belt 21 which is an endless belt. According to the configuration, the carrier liquid removal roller 43 is provided while abutting on the driving roller 41 of the intermediate transfer belt 21, so that the one roller can be eliminated. Accordingly, the space saving and cost reduction can be achieved in the carrier removal mechanism. Because the third bias applying section 93 is provided in the carrier liquid removal roller 43, the toner image is not moved to the carrier liquid removal roller 43.

Thus, the various embodiment of the present invention are described above. The scope of the present invention is not limited to these embodiments since various modifications can be made without departing from the spirit and the scope of the present invention.

In the present invention, "the lack of image" shall include a phenomenon in which density of the image second transferred to the paper is lower than usual.

Having thus described in detail preferred embodiments of the present invention, it is to be understood that the invention defined by the forgoing paragraphs is not to be limited to particular details and/or embodiments set forth in the above description, as many apparent variations thereof are possible without departing from the spirit or scope of the present invention.

What is claimed is:

1. An image forming apparatus comprising:

an image forming portion which is configured to form a toner image on one or a plurality of image bearing members using a liquid developer comprising a carrier liquid and toner which is dispersed in the carrier liquid;

an intermediate transfer section comprising an endless belt onto which the toner image is first transferred, and a plurality of rotating bodies for stretching and rotating the endless belt;

a second transfer roller which is disposed so that the second transfer roller faces one of the plurality of rotating bodies and abuts the endless belt to form a nip;

a first bias applying section which is connected to the second transfer roller, wherein the first bias applying section is configured to apply a transfer bias to the second transfer roller, where-in the first bias applying section applies the transfer bias to the second transfer roller when the toner image on the endless belt is second transferred to a recording medium passing through the nip and applies a reverse transfer bias having an opposite electric polarity as the transfer bias to the second transfer roller when the second transfer is not performed; and a second bias applying section which is connected to the rotating body facing the second transfer roller and is configured to apply a bias to the rotating body facing the second transfer roller.

2. The image forming apparatus according to claim 1, wherein the second bias applying section applies the bias during a transition time from the time when the first bias applying section starts a polarity changes from the reverse transfer bias to the transfer bias to the time when the transfer bias reaches a voltage or a current necessary to the second transfer.

3. The image forming apparatus according to claim 2, wherein the second bias applying section applies the bias to the rotating body facing the second transfer roller, having a same electric polarity as the reverse transfer bias applied by the first bias applying section.

4. The image forming apparatus according to claim 1, further comprising:

a carrier liquid removal roller which is disposed on an upstream side of the second transfer roller in a rotation direction of the endless belt so that the carrier liquid removal roller faces the rotating body which faces the second transfer roller and abuts on the endless belt in order to remove the carrier liquid from the toner image before the toner image is second transferred; and a third bias applying section which applies a bias having the same polarity as the reverse transfer bias applied by the first bias applying section and is connected to the carrier liquid removal roller.

5. The image forming apparatus according to claim 4, wherein the third bias applying section applies the bias having an absolute value not lower than the bias applied by the second bias applying section to the carrier liquid removal roller.

6. The image forming apparatus according to claim 1, wherein the second bias applying section turns off bias application once a recording medium enters the nip.

7. The image forming apparatus according to claim 1, wherein the second bias applying section applies a bias having a lower absolute value than the reverse transfer bias applied by the first bias applying section before the start of the change of the transfer bias applied by the first bias applying section from the reverse transfer bias.

8. A method for transferring a toner image from an intermediate transfer body onto a recording medium, the method comprising:

transferring a toner image onto an intermediate transfer section;

applying a first bias from a first bias applying section to a second transfer roller in order to second transfer the toner image from the intermediate transfer section onto a recording medium, and applying a reverse transfer bias from the first bias applying section to the second transfer roller when the second transfer is not performed, the reverse transfer bias having a polarity opposite of the first bias;

applying a second bias from a second bias applying section to a rotating body facing the second transfer roller with the same polarity as of the toner, such that an electric field is applied to the toner image on the intermediate transfer section; and applying a third bias from a third bias applying section to a carrier liquid removal roller with the same polarity as the second bias and with a voltage value more than or equal to the second bias, such that an electric field is applied to the toner image on the intermediate transfer section.

9. The method according to claim 8, wherein the second bias is applied with the same polarity as the reverse transfer bias of the first bias.

10. The method according to claim 8, wherein the second bias is applied during a transition time from a time when the first bias applying section starts a polarity change from the reverse transfer bias to the transfer bias to a time when the transfer bias which is applied from the first bias applying section reaches a voltage or a current necessary to the second transfer.

11. The method according to claim 8, wherein the toner image is formed from using a liquid developer containing a carrier liquid and toner which is dispersed in the carrier liquid.

12. The method according to claim 8, wherein the intermediate transfer section which has an endless belt and a plurality of rotating bodies for stretching and rotating the endless belt.

13. The method according to claim 9, wherein the first bias is applied to a second transfer roller which is disposed so that the second transfer roller faces one of a plurality of rotating bodies and abuts on an endless belt to form a nip.

14. The image forming apparatus according to claim 1, wherein the electrostatic potential difference between the second transfer roller and the rotating body facing the second transfer roller corresponds to the difference between the transfer bias applied by the first bias applying section and the bias applied by the second bias applying section.

* * * * *